US011425988B2

(12) United States Patent
Wu

(10) Patent No.: US 11,425,988 B2
(45) Date of Patent: Aug. 30, 2022

(54) PIPE CLEANING BRUSH

(71) Applicant: Sam Rock Industrial Co., Ltd., Kaohsiung (TW)

(72) Inventor: Kuei-Kun Wu, Kaohsiung (TW)

(73) Assignee: SAM ROCK INDUSTRIAL CO., LTD., Kaohsiung (TW)

( * ) Notice: Subject to any disclaimer, the term of this patent is extended or adjusted under 35 U.S.C. 154(b) by 173 days.

(21) Appl. No.: 17/061,256

(22) Filed: Oct. 1, 2020

(65) Prior Publication Data

US 2021/0368971 A1 Dec. 2, 2021

(30) Foreign Application Priority Data

May 29, 2020 (TW) ..... 109118087

(51) Int. Cl.
*A46B 5/00* (2006.01)
*A46B 13/08* (2006.01)

(52) U.S. Cl.
CPC ..... *A46B 5/0037* (2013.01); *A46B 13/08* (2013.01); *A46B 5/0041* (2013.01); *A46B 2200/3013* (2013.01)

(58) Field of Classification Search
CPC ..... A46B 5/00; A46B 5/0033; A46B 5/0037; A46B 5/0041; A46B 5/0045; A46B 5/0058; A46B 5/0062; A46B 5/0075; A46B 13/08; A46B 2200/3031; A46B 5/002
USPC ..... 15/160, 164, 165, 148–150; 401/9–11
See application file for complete search history.

(56) References Cited

U.S. PATENT DOCUMENTS 8,479,343 B2 * 7/2013 Smetana ..... B08B 9/087 15/59
2007/0119011 A1 * 5/2007 Ho ..... A46B 5/0062 15/164

FOREIGN PATENT DOCUMENTS

CN 207357720 U 5/2018

* cited by examiner

*Primary Examiner* — David J Walczak
(74) *Attorney, Agent, or Firm* — Muncy, Geissler, Olds & Lowe, P.C.

(57) ABSTRACT

A pipe cleaning brush which comprises a cleaning unit including a brush body and an elastic body, a connecting unit including a flexible strip, and a handle unit including a fixed handle and a plug-connected part that are separated and embedded with each other. The plug-connected part includes a first branch rod and a second branch rod. One end of the first branch rod and one end of the second branch rod are pivoted to each other to be opened or collapsed, and the first branch rod or the second branch rod is embedded and positioned above the fixed handle, so that the second branch rod or the first branch rod is rotated and to simultaneously drive the connecting unit and the cleaning unit to rotate.

8 Claims, 12 Drawing Sheets

PIPE CLEANING BRUSH

FIELD OF THE INVENTION

The invention relates to a pipe cleaning brush, more particularly to a pipe cleaning brush that rotates back and forth to clean inside an air duct of various clothes dryers and is capable of improving a service life of a brush body of the cleaning brush.

BACKGROUND OF THE INVENTION

Hot air with moisture content in an inner side of existing clothes dryers are exhausted to the outdoors by an air duct, however, a pipeline of the air duct is in curved shape with long length, and an air outlet is small, so that the air duct of the clothes dryers does not normally be cleaned up since the beginning of use, unless a condition that the air duct is torn down or displaced, otherwise only an air outlet cover of the air duct to be cleaned. After a long period of usage, an inner wall of the air duct is accumulated with a lot of cotton fibers and dust, which will not only affect the drying efficiency in the clothes dryers, but also cause blockage inside the air duct. As a result, the efficiency of heat exhaust in the air duct is poor, and large amount of cotton fibers may cause the risk of fire.

Therefore, as shown in FIG. 1, the manufacturers have developed a pipe cleaning brush 1 for cleaning cotton fibers and dust on an inner wall of an air duct of a clothes dryer. In particular, the pipe cleaning brush 1 includes a brush body 11, a flexible connecting portion 12 connected to one end of the brush body 11, and a handle 13 integrally connected with the flexible connecting portion 12. When a user's hand holds the handle 13 of the pipe cleaning brush 1, the pipe cleaning brush 1 is inserted into the inner wall of the air duct, because the handle 13 and the flexible connecting portion 12 are an integrative structure, the brush body 11 of the pipe cleaning brush 1 can only perform cleaning in a straight forward and backward displacement. If the brush body 11 is to be rotated, the user must turn his hand to drive the brush body 11 to rotate. However, a rotatable angle of the user's hand is very limited, which makes it difficult for the handle 13 to rotate, difficult to hold, and makes the user's hand feel uncomfortable. Furthermore, a plurality of round plastic bristles of the brush body 11 is straight rod-shaped, and their rigidity is not good, resulting in insufficient strength of the brush body 11. If the brush body 11 is deformed by cleaning bending parts of the air duct, the deformed round plastic bristles cannot be easily restored to their original shapes, and the efficiency of cleaning the inner wall of the air duct is lost. Therefore, the existing pipe cleaning brush 1 has the above-mentioned drawbacks.

In addition, some manufacturers have developed a pipe inner wall cleaner as shown in FIG. 2 with Chinese Utility Model Patent No. CN207357720U. A pipe inner wall cleaner 2 includes a handle 21, a sleeve 22, a flexible member 23 and a cleaning head 24. Wherein the handle 21 is sleeved in the sleeve 22, and one end of the handle 21 is connected to the flexible member 23, so that the flexible member 23 can pass through corners of a pipe smoothly. When the cleaning head 24 of the pipe inner wall cleaner 2 is to be used in the pipe, although the handle 21 can be rotated in the sleeve 22 to drive rotation of the flexible member 23, because the handle 21 is a fixed type handle, it is not easy to clean with the cleaning head 24 displacing back and forth in straight line through the fixed handle 21, and increase in an overall volume of the fixed handle 21 is not conducive to packaging and transportation. The fixed handle 21 also occupies a space for using the pipe inner wall cleaner 2, so the pipe inner wall cleaner 2 has the above-mentioned drawbacks. Therefore, how to develop a pipe cleaning brush that rotates back and forth to clean inside an air duct of various clothes dryers and is capable of improving a service life of a brush body of the cleaning brush is an urgent issue to be solved by the industry.

SUMMARY OF THE INVENTION

A main object of the invention is provide a improved pipe cleaning brush to solve the drawbacks of the existing pipe inner wall cleaner, which solves the difficulty of holding and discomfort to hold, and solves the difficulty in cleaning with the cleaning head displacing back and forth in straight line through the fixed handle. The invention also solves the problems of the existing pipe inner wall cleaner that is hard to be packaged and transported, and occupies a space since the overall volume of the fixed handle of the existing pipe inner wall cleaner is large. The invention provides a pipe cleaning brush which comprises a first branch rod and a second branch rod pivotally connected with each other to allow the first branch rod and the second branch rod being pivoted to each other to be opened or collapsed, and the first branch rod and the second branch rod is embedded above a fixed handle, so that the second branch rod or the first branch rod is rotated to simultaneously drive the fix handle, the connecting unit, and the cleaning unit 4 to rotate, and a plurality of cotton fibers in an air duct of a clothes dryer is cleaned. When the pipe cleaning brush of the invention is not used, a plug-connected part is embedded with the fixed handle to collapse the plug-connected part for convenience of packaging and transportation, and a strength of a brush body of the pipe cleaning brush can be increased without being easily deformed, so as to improve a service life of the brush body.

According to the foregoing object, the invention provides a pipe cleaning brush for cleaning a plurality of cotton fibers in an air duct of a clothes dryer. The pipe cleaning brush includes a cleaning unit, a connecting unit and a handle unit. The cleaning unit includes a brush body inserting into an inner wall of the air duct to clean up, and an elastic body fixed in series at a central position of the brush body. The connecting unit includes a flexible strip with a bendable function to connect with one end of the elastic body. The handle unit includes a fixed handle and a plug-connected part that are separated and embedded with each other, wherein one end of the fixed handle is connected to one end of the flexible strip opposite to the elastic body. The plug-connected part includes a first branch rod and a second branch rod, one end of the first branch rod and one end of the second branch rod are respectively provided with a first pivotal end and a second pivotal end, the first pivotal end and the second pivotal end are pivotally connected with each other to allow the first branch rod and the second branch rod being pivoted to each other to be opened or collapsed, one end of the first branch rod opposite to the first pivotal end is provided with a first embedding end and one end of the second branch rod opposite to the second pivotal end is provided with a second embedding end. The first embedding end and the second embedding end are respectively embedded with the fixed handle to fold the plug-connected part for convenient packaging and transportation, and the first branch rod and the second branch rod are pivoted to each other to be opened and fixed, and the first branch rod or the second branch rod is embedded and positioned above the fixed handle, and the second branch rod or the first branch rod is rotated, and to simultaneously drive the connecting unit and the cleaning unit to rotate to clean the cotton fibers in the air duct of the clothes dryer.

Further, other end of the fixed handle which is not connected to the flexible strip is provided with two first embedding holes for the first embedding end and the second embedding end to be inserted and positioned in the first embedding holes respectively, and at a central position of the fixed handle is provided with a second embedding hole perpendicular to the first embedding holes and penetrating the fixed handle for the first embedding end or the second embedding end to be inserted and positioned in the second embedding hole, and the second embedding end or the first embedding end and the fixed handle is arranged in a same direction with the fixed handle.

Further, an outer side of each of the two first embedding is a circular hole, and the inner side of each of the two first embedding is a polygonal hole connected with the circular hole, and the second embedding hole is a polygonal hole; wherein the first branch rod and the second branch rod are in circular shape, and the first embedding end and the second embedding end are in polygon shape to match with shapes of the inner side of each of the two first embedding holes and the second embedding hole.

Further, a first hole is provided at one end of the fixed handle opposite to the flexible strip, and the first hole perpendicularly passes through one of the first embedding holes and parallels the second embedding hole, and wherein one end of the first branch rod close to the first embedding end is provided with a second hole which is embedded with one of the two first embedding holes and aligned with the first hole, and a binding member penetrates into the first hole and the second hole to secure the handle and the plug-connected part after embedded with each other.

Further, the first pivotal end includes a pivotal hole, an curved protrusion, a first protrusion, and a first block, and wherein the pivotal hole is located at a central position of the first pivotal end, the curved protrusion is adjacent to the first branch rod and facing the second pivotal end, the first protrusion located at one end of the curved protrusion with a first groove, and the first block is connected to one end of the curved protrusion opposite to the first protrusion; and wherein the second pivotal end includes a convex shaft, an curved groove, a second protrusion, and a second block, wherein the convex shaft is located at a central position of the second pivotal end and facing toward the first pivotal end, the curved groove is adjacent to the second branch rod and facing toward the first pivotal end to provide for the curved protrusion to rotate, the second protrusion is located at one end of the second pivotal end opposite to the second branch rod with a second groove, and the second block is connected to one end of the second pivotal end opposite to the second protrusion and abutted against the first block, the convex shaft is provided with a through hole located inside the convex shaft and penetrated through the second pivotal end, a slot located at a corresponding position of the convex shaft to divide the convex shaft into semi circles and to make the convex shaft elastic, and a protruding parapet extending toward an outer side of the convex shaft to penetrate into the pivotal hole and engage on an outer side of the pivotal hole, wherein an outer diameter of the protruding parapet is larger than an outer diameter of the convex shaft, the second protrusion is rotated and engaged in the first groove, the first protrusion is rotated and engaged in the second groove, and an open-state is present by the first pivotal end and the second pivotal end, and the first block abuts against the second block, and a closed-state is present by the first pivotal end and the second pivotal end.

Further, the brush body includes a plurality of round plastic bristles fixed in series with the elastic body, and the plurality of round plastic bristles are wavy-shaped.

Further, one end of the elastic body is inserted and fixed inside one end of the flexible strip.

Further, an outer side of the flexible strip is covered with a soft protection sleeve.

In summary, the pipe cleaning brush of the invention is capable of achieving the following features:

1. The pipe cleaning brush of the invention is used to clean the cotton fibers in the air duct of various clothes dryers, with the first embedding end or the second embedding end inserted and positioned in the second embedding hole, the second embedding end or the first embedding end and the fixed handle are arranged in a same direction for the user's hand to hold and rotate the second branch rod or the first branch rod, and to drive the fixed handle to rotate, and simultaneously driving the connecting unit and the cleaning unit to rotate, so that the pipe cleaning brush inserted into the air duct is capable of rotating with rotation of the hand.

2. The brush body of the pipe cleaning brush of the invention rotates on the inner wall of the air duct of the clothes dryer, with the wavy-shaped round plastic bristles of the brush body, in addition to enhancing a hardness and causing the brush body to be difficult to deform, and improving a function of the brush body to grab the cotton fibers, so that one end of the brush body is capable of abutting against recesses of the inner wall of the air duct and grabbing the cotton fibers in the recesses; if one end of the brush body abuts against convex parts of the inner wall of the air duct, the round plastic bristles will bend but immediately return to the original shape, so that one end of each of the round plastic bristles that abuts against the convex parts of the inner wall of the air duct is also capable of grabbing the cotton fibers on the convex parts of the inner wall of the air duct, so as to prevent the brush body from being deformed or damaged by touching the inner wall of the air duct, and to increase the service life of the brush body, and then continue to move the brush body back and forth in the air duct of the clothes dryer and rotate the brush body, and grab and remove the cotton fibers on the inner wall of the air duct.

3. When the pipe cleaning brush of the invention is not in use, the second embedding end or the first embedding end positioned in the second embedding hole is taken out so that the first pivotal end and the second pivotal end are not engaged, with the first stopper abutting against the second stopper, the first pivotal end and the second pivotal end are folded, and by inserting and positioning the first embedding end and the second embedding end into the first embedding holes to fold the plug-connected part, an overall volume of the handle unit can be reduced, so that the pipe cleaning brush can be packaged and transported without occupying space.

DETAILED DESCRIPTION OF THE PREFERRED EMBODIMENTS

In order to enable the examiner to have a deeper understanding and recognition of the features, objects and efficacies of the invention, a preferred embodiment is provided below in conjunction with the accompanying drawings.

Figure 1:
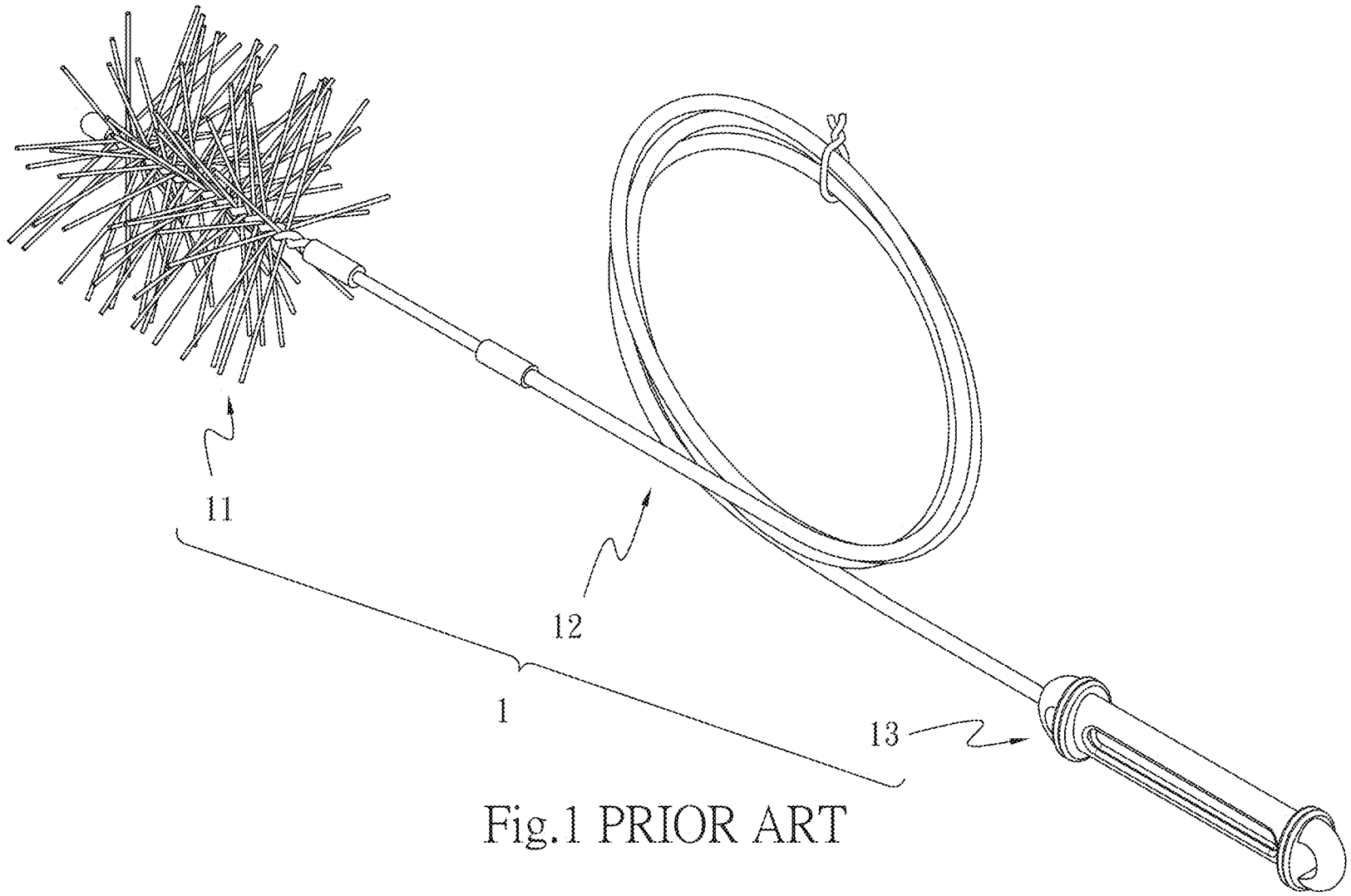
Fig.1 PRIOR ART
FIG. 1 is a perspective view of an existing pipe cleaning brush being folded.
Figure 2:
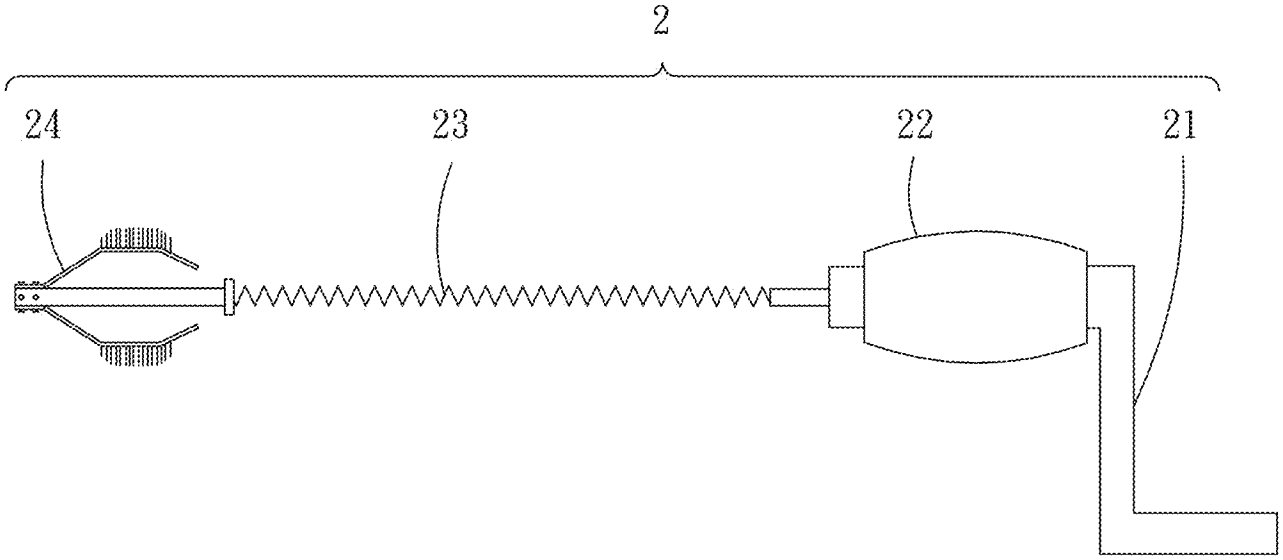
Fig.2 PRIOR ART
FIG. 2 is a front view of another existing pipe cleaning brush.
Figure 3:
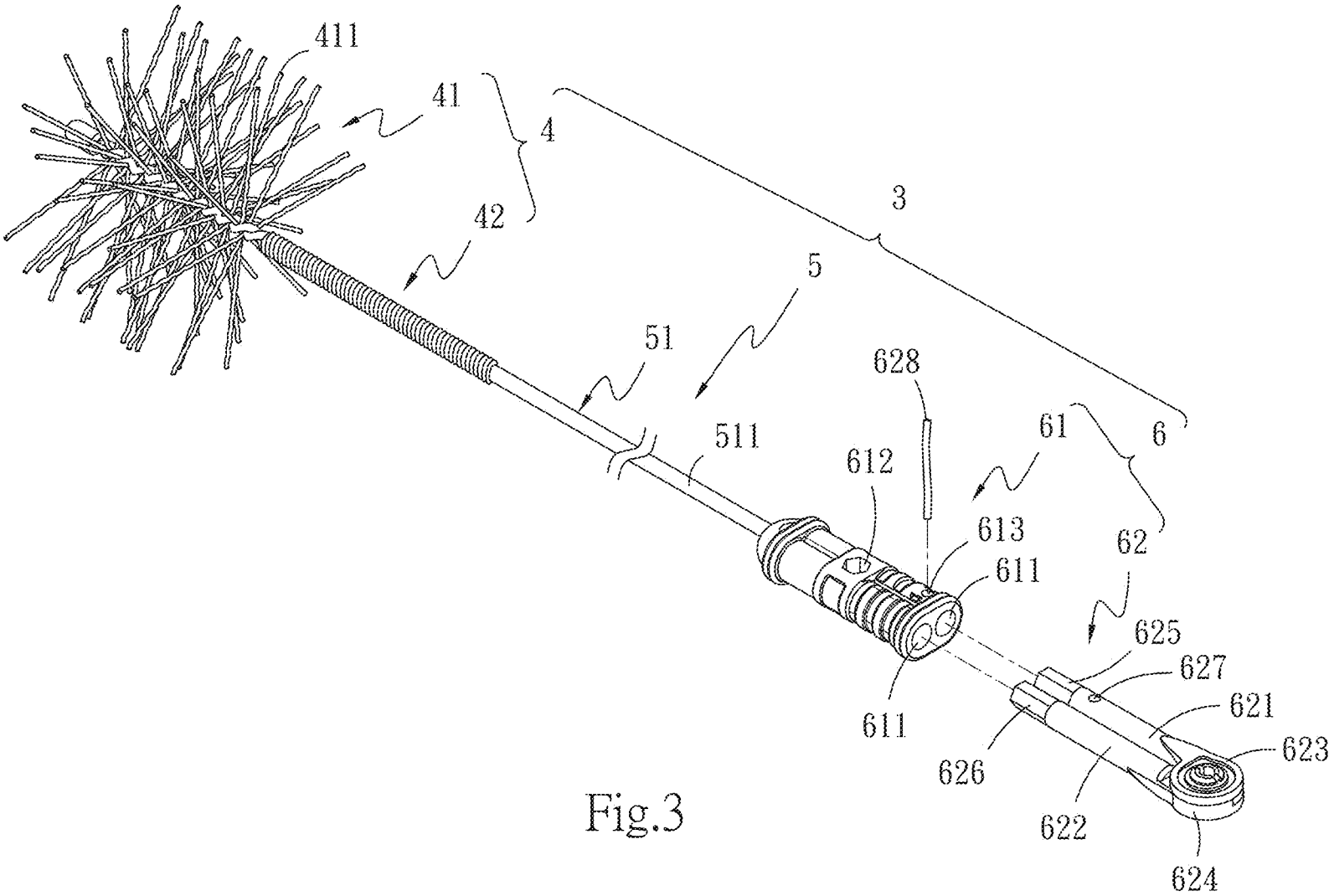
FIG. 3 is a perspective exploded view of a pipe cleaning brush of the invention.
Figure 4A:
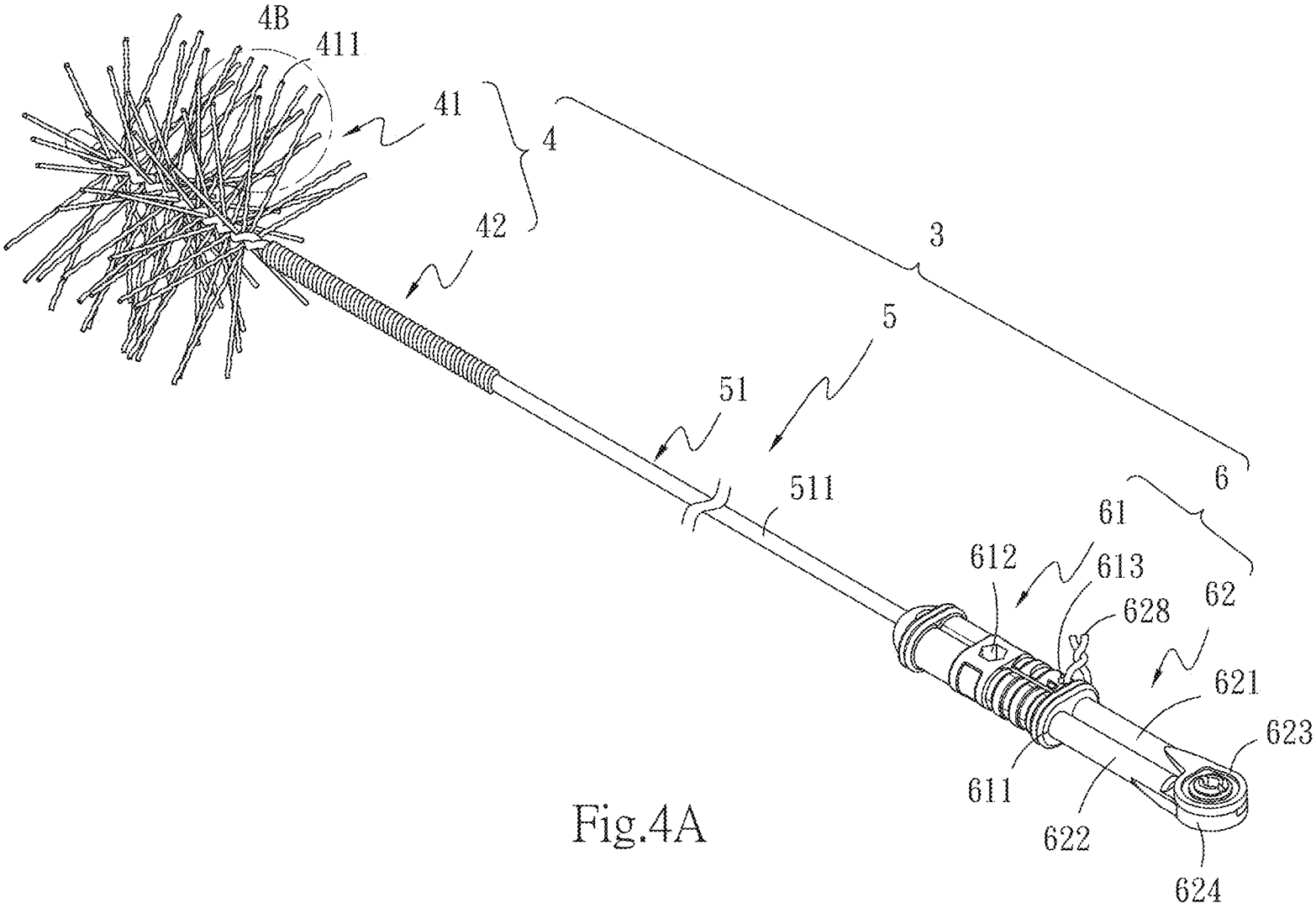
FIG. 4A is a perspective assembly view of the pipe cleaning brush in FIG. 3.
Figure 4B:
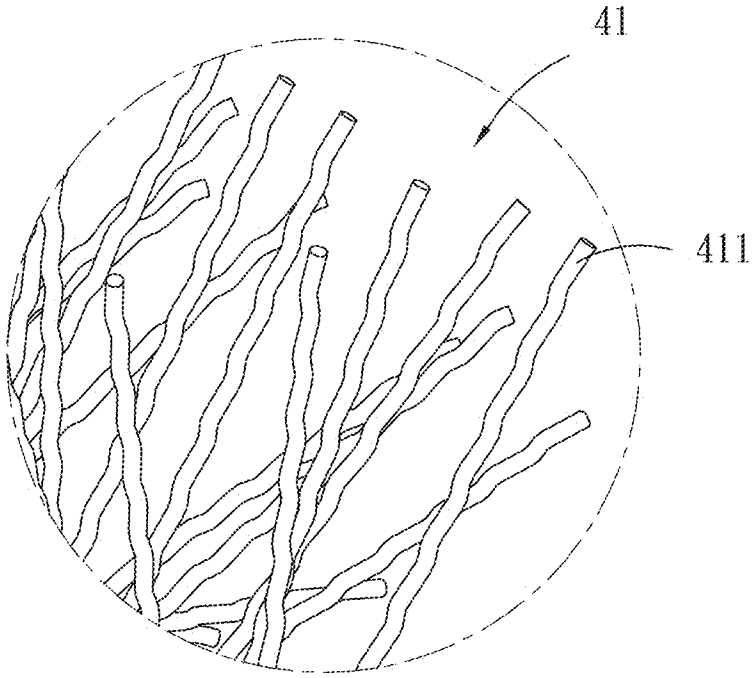
FIG. 4B is an enlarged view of position 4B of the pipe cleaning brush in FIG. 4A.

Please refer to FIG. 3, FIG. 4A, FIG. 4B, FIG. 5, FIG. 6. FIG. 7, FIG. 8, FIG. 9, FIG. 10, FIG. 11 and FIG. 12, the invention provides a pipe cleaning brush 3 for cleaning a plurality of cotton fibers 72 in an air duct 71 of a clothes dryer 7. The pipe cleaning brush 3 includes a cleaning unit 4, a connecting unit 5 and a handle unit 6. The cleaning unit 4 includes a brush body 41 inserting into an inner wall of the air duct 71 to clean up, and an elastic body 42 fixed in series at a central position of the brush body 41. In this embodiment, the brush body 41 includes a plurality of round plastic bristles 411 fixed in series with the elastic body 42. The plurality of round plastic bristles 411 are wavy-shaped with strong rigidity to not only increase hardness but also improve an ability of grabbing the plurality of cotton fibers 72 without being easily deformed, as shown in FIG. 4B. During a process that the brush body 41 inserts into the inner wall of the air duct 71 for cleaning up, one end of each of the plurality of round plastic bristles 411 abuts against recesses 711 on the inner wall of the air duct 71 to be capable of grabbing the cotton fibers 72 in the recesses 711. If one end of each of the plurality of round plastic bristles 411 abuts against convex parts 712 of the inner wall of the air duct 71, the plurality of round plastic bristles 411 will be bent and immediately be restored, so as to prevent the plurality of round plastic bristles 411 from being deformed or damaged when abutting against the inner wall of the air duct 71 to increase a service life of the plurality of round plastic bristles 411.

The connecting unit 5 includes a flexible strip 51 with a bendable function to connect with one end of the elastic body 42. The connecting unit 5 is wound into a folded state through the flexible strip 51. Specifically, one end of the flexible strip 51 is provided a one end of the elastic body 42 for inserting and to be fixed, and a soft protection sleeve 511 is covered on an outer side of the flexible strip 51.

The handle unit 6 includes a fixed handle 61 and a plug-connected part 62 that are separated and embedded with each other, wherein one end of the fixed handle 61 is connected to one end of the flexible strip 51 where is opposite to the elastic body 42, and the other end of the fixed handle 61 is provided with two first embedding holes 611, and at a central position of the fixed handle 61 is provided with a second embedding hole 612 perpendicular to the first embedding holes 611 and penetrating the fixed handle 61. More specifically, an outer side of each of the two first embedding holes 611 is a circular hole, and the inner side of each of the two first embedding holes is a polygonal hole and connects to the second embedding hole 612 which is a polygonal hole. In this embodiment, the inner side of each of two first embedding holes 611 and the second embedding hole 612 are hexagonal holes. Moreover, a first hole 613 is provided at one end of the fixed handle 61 where is opposite to the flexible strip 51, and the first hole 613 perpendicularly passes through one of the first embedding holes 611 and parallels the second embedding hole 612.

Please refer to FIG. 6, FIG. 7, FIG. 8, FIG. 9 and FIG. 10. The plug-connected part 62 includes a first branch rod 621 and a second branch rod 622. One end of the first branch rod 621 and one end of the second branch rod 622 are respectively provided with a first pivotal end 623 and a second pivotal end 624. The first pivotal end 623 and the second pivotal end 624 are pivotally connected with each other to allow the first branch rod 621 and the second branch rod 622 being pivoted to each other to be opened or collapsed. One end of the first branch rod 621 opposite to the first pivotal end 623 is provided with a first embedding end 625, and one end of the second branch rod 622 opposite to the second pivotal end 624 is provided with a second embedding end 626, wherein the first embedding end 625 and the second embedding end 626 are respectively inserted and positioned in the two first embedding holes 611. In order to match with shapes of the inner side of each of the two first embedding holes 611 and the second embedding hole 612, the first embedding end 625 and the second embedding end 626 are in polygon shape. In this embodiment, the first embedding end 625 and the second embedding end 626 are tightly matching with the inner side of the first embedding hole 611 and the second embedding hole 612 in hexagonal shape. When a user want to rotate the fixed handle 61, the first embedding end 625 or the second embedding end 626 is inserted and positioned in the second embedding hole 612, so that the second embedding end 626 or the first embedding end 625 is arranged in a same direction with the fixed handle 61 for the user's hand to hold the second branch rod 622 or the first branch rod 621 to rotate, and then the fixed handle 61, the connecting unit 5 and the cleaning unit 4 are simultaneously driven to rotate.

The first branch rod 621 and the second branch rod 622 are in circular shape. One end of the first branch rod 621 close to the first embedding end 625 is provided with a second hole 627 which is embedded with one of the two first embedding holes 611 and aligned with the first hole 613, and then a binding member 628 penetrates into the first hole 613 and the second hole 627 to secure the fixed handle 61 and the plug-connected part 62 after embedded with each other to prevent the plug-connected part 62 from falling off from the two first embedding holes 611.

Figure 5:
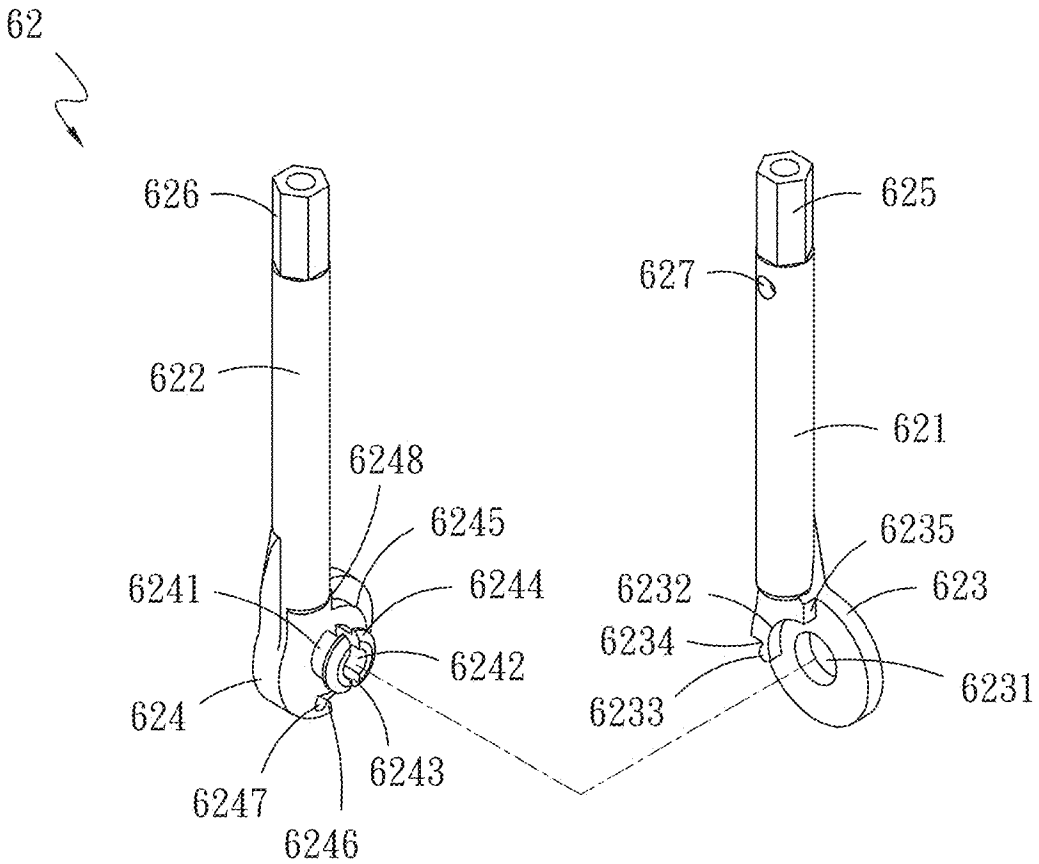
FIG. 5 is a perspective exploded view of a plug-connected part of FIG. 3.
Figure 7:
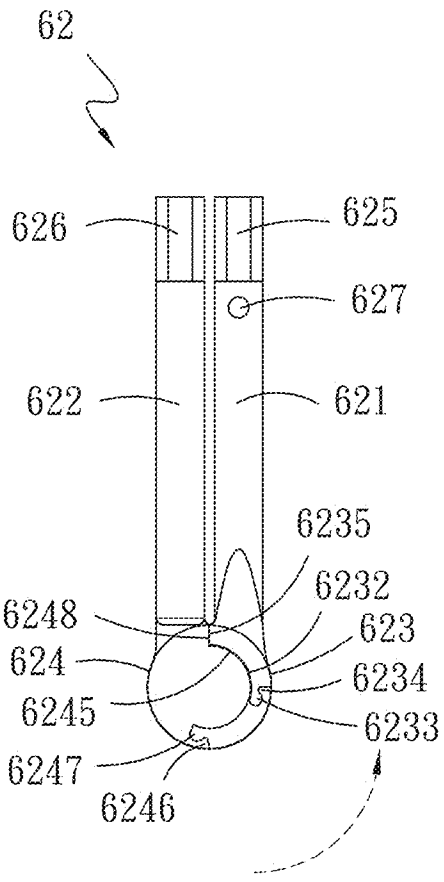
FIG. 7 is a schematic diagram of the first branch rod and the second branch rod of the plug-connected part of FIG. 3 being folded.
Figure 6:
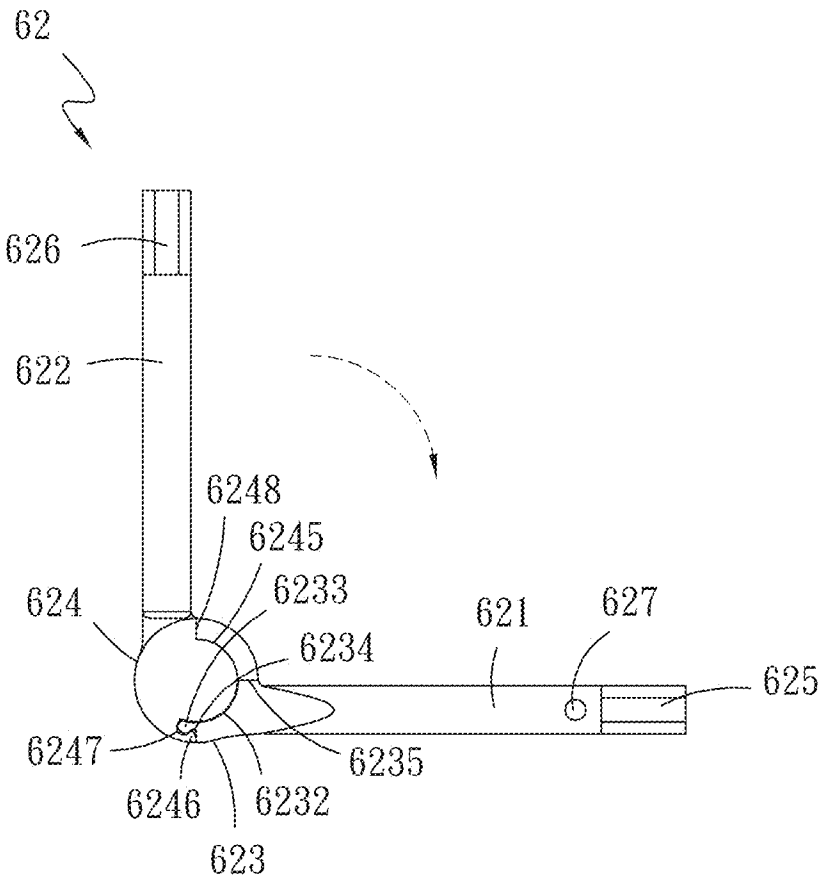
FIG. 6 is a schematic diagram of a first branch rod and a second branch rod of the plug-connected part of FIG. 3 being unfolded.
Figure 8:
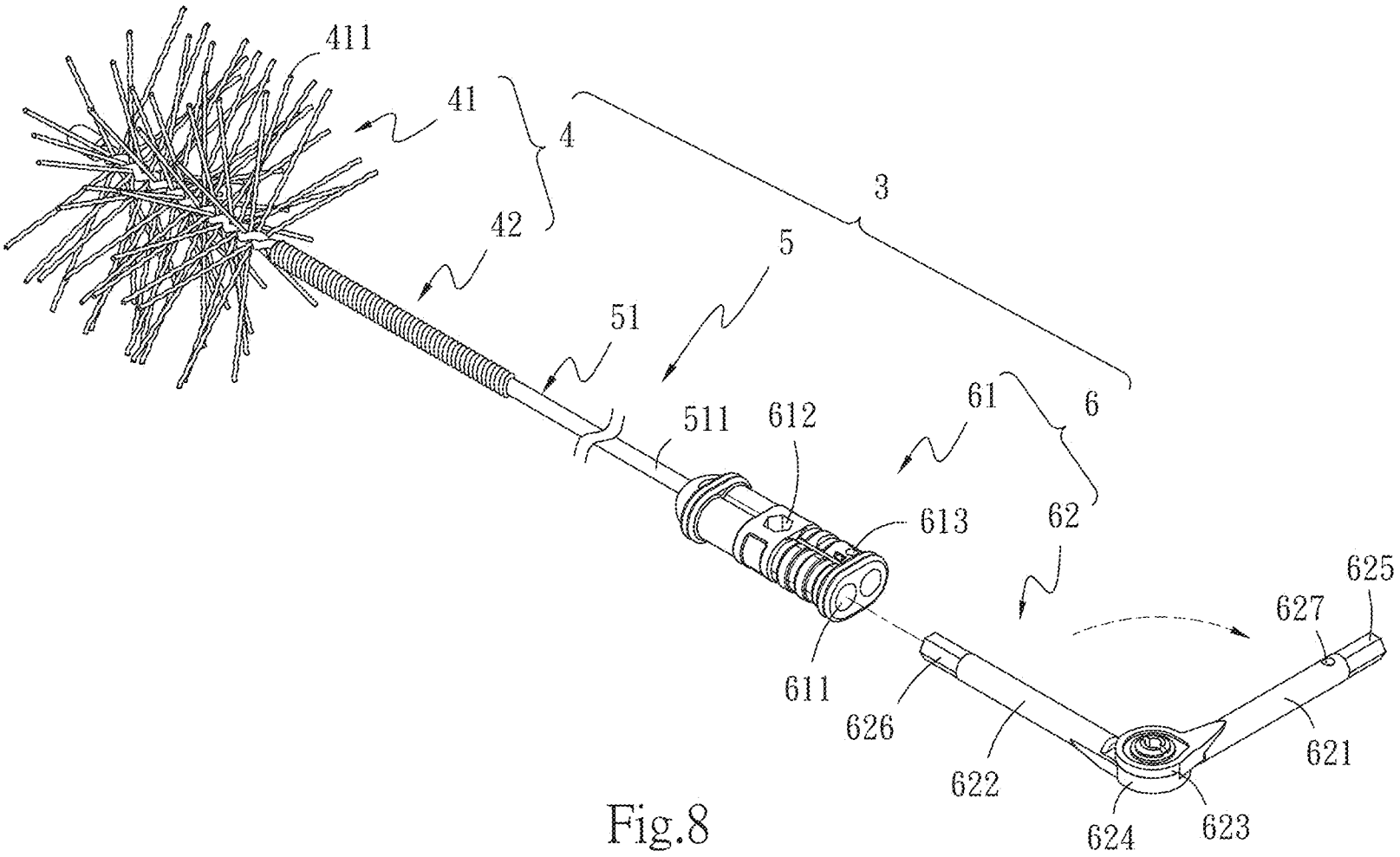
FIG. 8 is a perspective view of a fixed handle and the unfolded first branch rod and second branch rod of the plug-connected part of FIG. 3.
Figure 9:
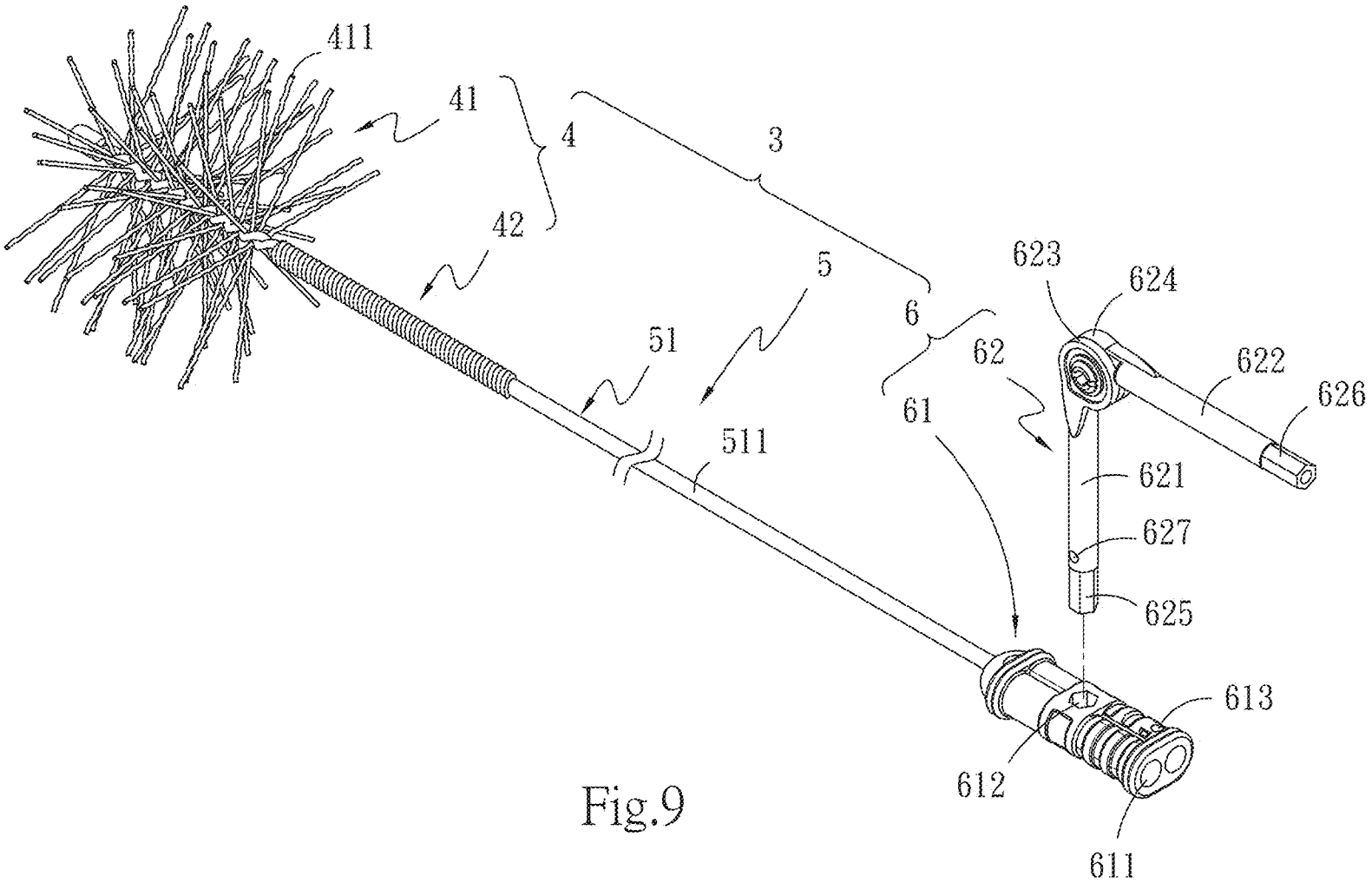
FIG. 9 is a perspective exploded view of the fixed handle and the unfolded first branch rod of the plug-connected part of FIG. 3 ready to be embedded.
Figure 10:
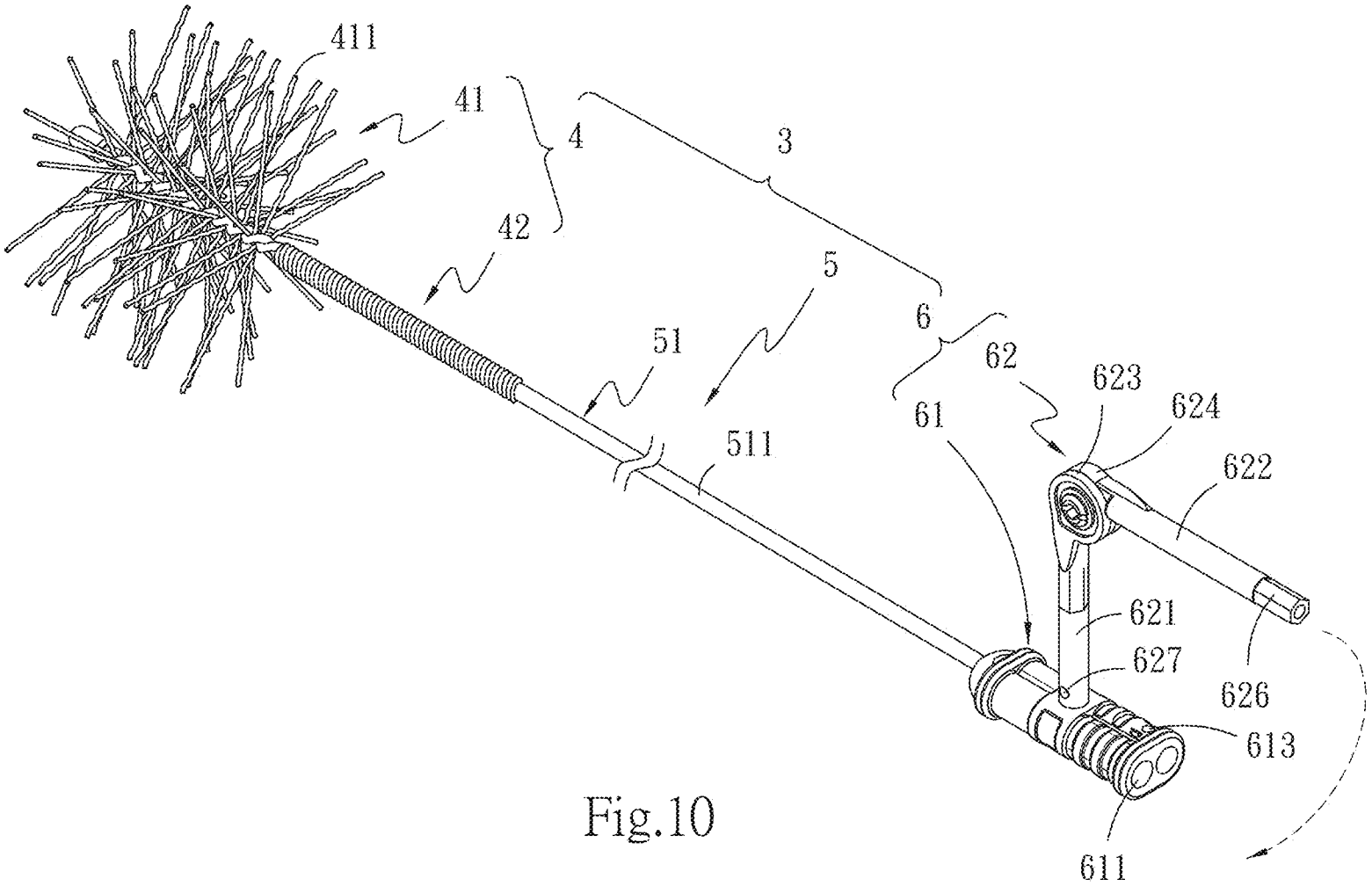
FIG. 10 is a perspective view of rotating the second branch rod and driving the fixed handle of FIG. 9 to rotate.
Figure 11:
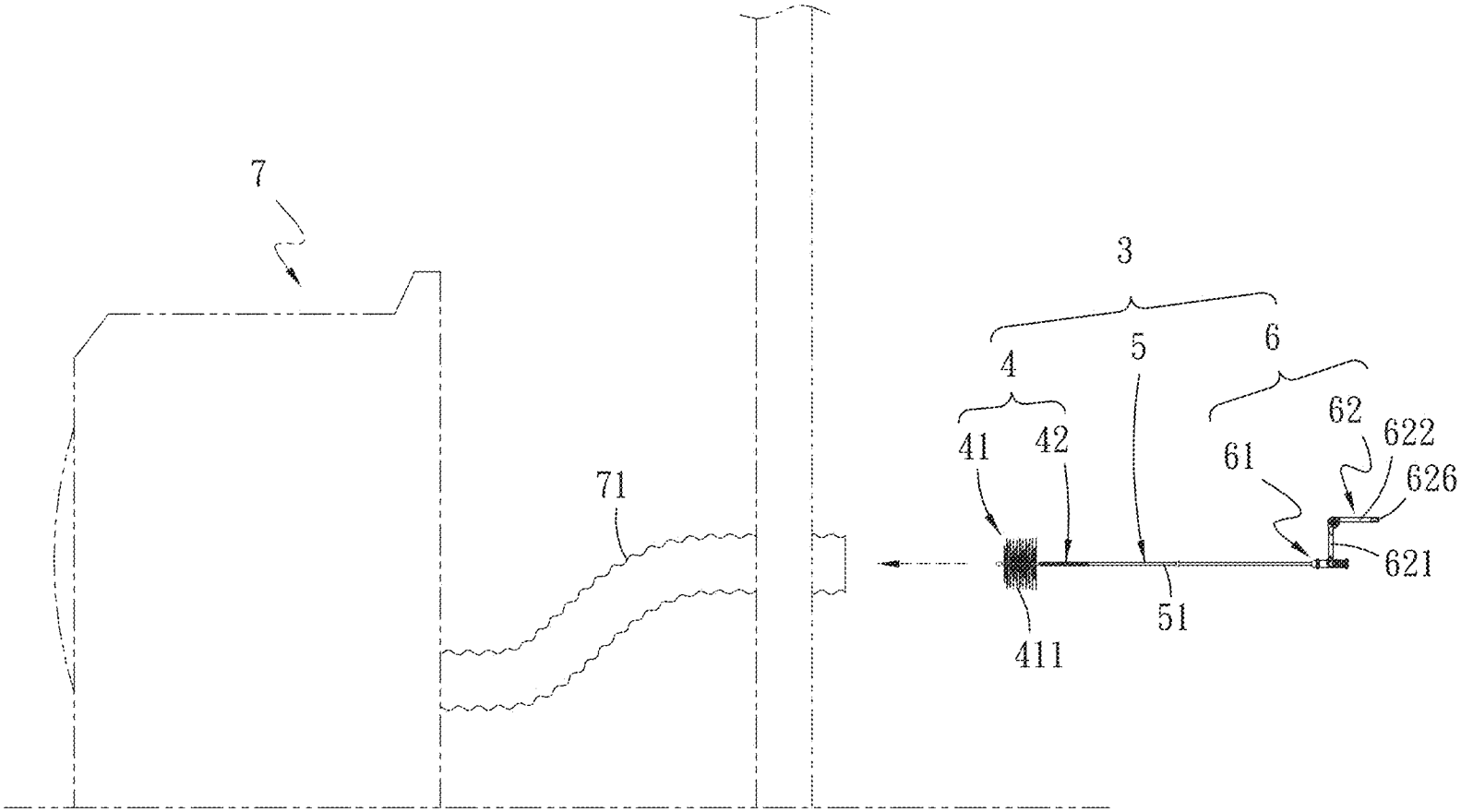
FIG. 11 is a side view of the pipe cleaning brush of FIG. 3 ready to be inserted into an air duct of a clothes dryer.

As shown in FIG. 5, FIG. 6 and FIG. 7, the first pivotal end 623 includes a pivotal hole 6231, an curved protrusion 6232, a first protrusion 6233 and a first block 6235, wherein the pivotal hole 6231 is located at a central position of the first pivotal end 623, the curved protrusion 6232 is adjacent to the first branch rod 621 and facing toward the second pivotal end 624, the first protrusion 6233 is located at one end of the curved protrusion 6232 with a first groove 6234, and the first block 6235 is connected to one end of the curved protrusion 6232 opposite to the first protrusion 6233. The second pivotal end 624 includes a convex shaft 6241, an curved groove 6245, a second protrusion 6246 and a second block 6248, wherein the convex shaft 6241 is located at a central position of the second pivotal end 624, the curved groove 6245 is adjacent to the second branch rod 622 and facing toward one side of the first pivotal end 623 to provide for the curved protrusion 6232 to rotate, the second protrusion 6246 is located at one end of the second pivotal end 624 opposite to the second branch rod 622 with a second groove 6247, and the second block 6248 is connected to one end of the second pivotal end 624 opposite to the second protrusion 6246 and abutted against the first block 6235. The convex shaft 6241 is provided with a through hole 6242 located inside the convex shaft 6241 and penetrated through the second pivotal end 624, a slot 6243 located at a corresponding position of the convex shaft 6241 to divide the convex shaft 6241 into semi-circles, and a protruding parapet 6244 extending toward an outer side of the convex shaft 6241 to penetrate into the pivotal hole 6231 and engage on an outer side of the pivotal hole 6231. The convex shaft 6241 is inserted into the pivotal hole 6231 or moved out of the pivotal hole 6231 through an elasticity of the slot 6243. An outer diameter of the protruding parapet 6244 is larger than an outer diameter of the convex shaft 6241. The second protrusion 6246 is rotated and engaged in the first groove 6234, the first protrusion 6233 is rotated and engaged in the second groove 6247, so that an open-state is presented by the first pivotal end 623 and the second pivotal end 624. The first block 6235 abuts against the second block 6248, so that a closed-state is presented by the first pivotal end 623 and the second pivotal end 624.

Figure 12:
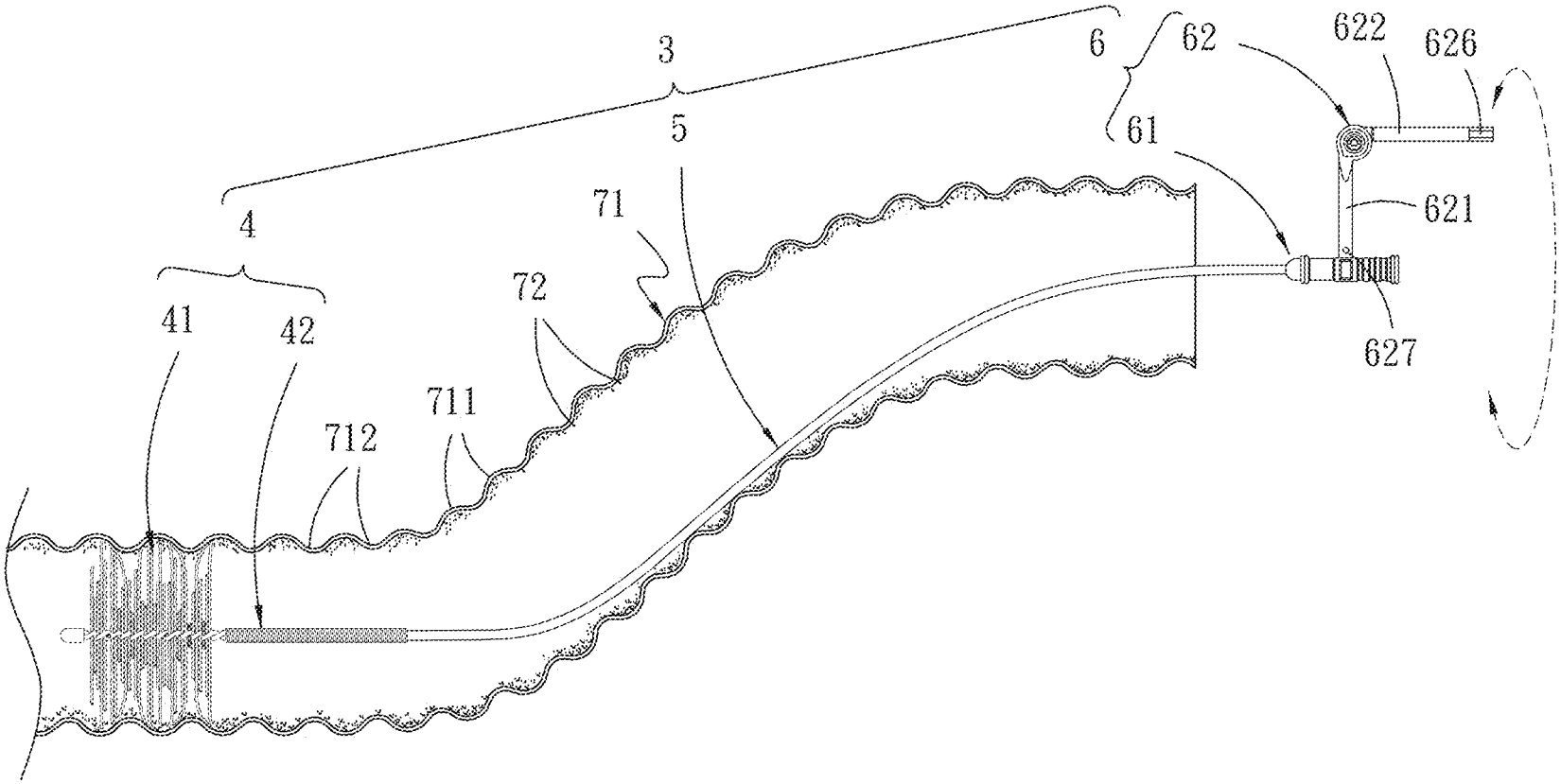
FIG. 12 is a side view of the pipe cleaning brush of FIG. 11 being inserted into the air duct of the clothes dryer and grabbing cotton fibers in the air duct of the clothes dryer.

Please refer to FIG. 8, FIG. 9, FIG. 10, FIG. 11 and FIG. 12. When using the pipe cleaning brush 3, the first branch rod 621 and the second branch rod 622 are first rotated by the user to present the open-state, and then the second protrusion 6246 is rotated and engaged in the first groove 6234, the first protrusion 6233 is rotated and engaged in the second groove 6247, and the first embedding end 625 or the second embedding end 626 of the first branch rod 621 is inserted and positioned in the second embedding hole 612, so that the first embedding end 625 or the second embedding end 626 are disposed in a same direction with the fixed handle 61 for the user to hold with a hand to clean up the inner wall of the air duct 71 by inserting the brush body 41. During this process, the second branch rod 622 or the first branch rod 621 is rotated by the user's hand to simultaneously drive the fix handle 61, the connecting unit 5 and the cleaning unit 4 to rotate, and the brush body 41 will be rotated on the inner wall of the air duct 71 of the clothes dryer 7. One end of each of the plurality of round plastic bristles 411 of the brush body 41 abuts against the recesses 711 on the inner wall of the air duct 71 to be capable of grabbing the cotton fibers 72 in the recesses 711. If one end of the plurality of round plastic bristles 411 abuts against the convex parts 712 of the inner wall of the air duct 71, the plurality of round plastic bristles 411 will be bent and immediately be restored, so that one end of the plurality of round plastic bristles 411 abutted against the convex parts 712 of the inner wall of the air duct 71 is also capable of grabbing the cotton fibers 72 on the convex parts 712 of the inner wall of the air duct 71. The brush body 41 continuously moves back and forth in the air duct 71 of the clothes dryer 7 so as to improve an efficiency of grabbing and removing the cotton fibers 72 on the inner wall of the air duct 71 as shown in FIG. 12.

When the pipe cleaning brush 3 is not used, the first embedding end 625 or the second embedding end 626 positioned in the second embedding hole 612 is taken out, so that the second protrusion 6246 is separated from the first groove 6234, and the first protrusion 6233 is separated from the second groove 6247, so that the first pivotal end 623 and the second pivotal end 624 are in the closed-state through the first block 6235 abutting against the second block 6248, and then the first embedding end 625 and the second embedding end 626 are respectively inserted and positioned in the two first embedding holes 611 to close the plug-connected part 62, as shown in FIG. 4. In this way, an overall volume of the handle unit 6 is reduced so that the pipe cleaning brush 3 is packaged and transported without occupying space.

What is claimed is:

1. A pipe cleaning brush for cleaning a plurality of cotton fibers in an air duct of a clothes dryer, and the pipe cleaning brush comprising:

a cleaning unit, including a brush body for inserting into an inner wall of the air duct to clean up, and an elastic body fixed in series at a central position of the brush body;

a connecting unit, including a flexible strip with a bendable function to connect with one end of the elastic body; and a handle unit, including a fixed handle and a plug-connected part which are separated and embedded with each other, wherein one end of the fixed handle is connected to one end of the flexible strip opposite to the elastic body, and the plug-connected part includes a first branch rod and a second branch rod, one end of the first branch rod and one end of the second branch rod are respectively provided with a first pivotal end and a second pivotal end, the first pivotal end and the second pivotal end are pivotally connected with each other to allow the first branch rod and the second branch rod being pivoted to each other to be opened or collapsed, one end of the first branch rod opposite to the first pivotal end is provided with a first embedding end and one end of the second branch rod opposite to the second pivotal end is provided with a second embedding end, the first embedding end and the second embedding end are respectively embedded with the fixed handle to fold the plug-connected part for convenient packaging and transportation, and the first branch rod and the second branch rod are pivoted to each other to be opened and fixed, and the first branch rod or the second branch rod is embedded and positioned above the fixed handle, and the second branch rod or the first branch rod is rotated and to simultaneously drive the connecting unit and the cleaning unit to rotate to clean the cotton fibers in the air duct of the clothes dryer.

2. The pipe cleaning brush as claimed in claim 1, wherein other end of the fixed handle which is not connected to the flexible strip is provided with two first embedding holes for the first embedding end and the second embedding end to be inserted and positioned in the two first embedding holes respectively, and at a central position of the fixed handle is provided with a second embedding hole perpendicular to the two first embedding holes and penetrating the fixed handle for the first embedding end or the second embedding end to be inserted and positioned in the second embedding hole, and the second embedding end or the first embedding end is arranged in a same direction with the fixed handle.

3. The pipe cleaning brush as claimed in claim 2, wherein an outer side of each of the two first embedding is a circular hole, and the inner side of each of the two first embedding is a polygonal hole connected with the circular hole, and the second embedding hole is a polygonal hole, wherein the first branch rod and the second branch rod are in circular shape, and the first embedding end and the second embedding end are in polygon shape to match with shapes of the inner side of each of the two first embedding holes and the second embedding hole.

4. The pipe cleaning brush as claimed in claim 3, wherein a first hole is provided at one end of the fixed handle opposite to the flexible strip, and the first hole perpendicularly passes through one of the two first embedding holes and parallels the second embedding hole, and wherein one end of the first branch rod close to the first embedding end is provided with a second hole which is embedded with one of the two first embedding holes and aligned with the first hole, and a binding member penetrates into the first hole and the second hole to secure the fixed handle and the plug-connected part after embedded with each other.

5. The pipe cleaning brush as claimed in claim 1, wherein the first pivotal end includes a pivotal hole, an curved protrusion, a first protrusion, and a first block, and wherein the pivotal hole is located at a central position of the first pivotal end, the curved protrusion is adjacent to the first branch rod and facing the second pivotal end, the first protrusion located at one end of the curved protrusion with a first groove, and the first block is connected to one end of the curved protrusion opposite to the first protrusion; and wherein the second pivotal end includes a convex shaft, an curved groove, a second protrusion, and a second block, wherein the convex shaft is located at a central position of the second pivotal end and facing toward the first pivotal end, the curved groove is adjacent to the second branch rod and facing toward the first pivotal end to provide for the curved protrusion to rotate, the second protrusion is located at one end of the second pivotal end opposite to the second branch rod with a second groove, and the second block is connected to one end of the second pivotal end opposite to the second protrusion and abutted against the first block, the convex shaft is provided with a through hole located inside the convex shaft and penetrated through the second pivotal end, a slot located at a corresponding position of the convex shaft to divide the convex shaft into semi-circles and to make the convex shaft elastic, and a protruding parapet extending toward an outer side of the convex shaft to penetrate into the pivotal hole and engage on an outer side of the pivotal hole, wherein an outer diameter of the protruding parapet is larger than an outer diameter of the convex shaft, the second protrusion is rotated and engaged in the first groove, the first protrusion is rotated and engaged in the second groove, and an open-state is present by the first pivotal end and the second pivotal end, and the first block abuts against the second block, and a closed-state is present by the first pivotal end and the second pivotal end.

6. The pipe cleaning brush as claimed in claim 1, wherein the brush body includes a plurality of round plastic bristles fixed in series with the elastic body, and the plurality of round plastic bristles are wavy-shaped.

7. The pipe cleaning brush as claimed in claim 1, wherein one end of the elastic body is inserted and fixed inside one end of the flexible strip.

8. The pipe cleaning brush as claimed in claim 1, wherein an outer side of the flexible strip is covered with a soft protection sleeve.

* * * * *